US012146373B2

(12) United States Patent
Hou et al.

(10) Patent No.: US 12,146,373 B2
(45) Date of Patent: Nov. 19, 2024

(54) UNDERBALANCED DRILLING VIBRATING SCREEN INTEGRATED WITH AUTOMATIC DRAINAGE AND VACUUM CHUCKS

(71) Applicant: Southwest Petroleum University, Chengdu (CN)

(72) Inventors: Yongjun Hou, Chengdu (CN); Duyu Hou, Chengdu (CN); Pan Fang, Chengdu (CN); Mingjun Du, Chengdu (CN); Yuwen Wang, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 59 days.

(21) Appl. No.: 18/161,187

(22) Filed: Jan. 30, 2023

(65) Prior Publication Data

US 2023/0417113 A1 Dec. 28, 2023

(30) Foreign Application Priority Data

Jun. 23, 2022 (CN) ..... 202210720366.0

(51) Int. Cl.
*E21B 21/06* (2006.01)
*E21B 21/08* (2006.01)

(52) U.S. Cl.
CPC ..... *E21B 21/065* (2013.01); *E21B 21/085* (2020.05)

(58) Field of Classification Search
CPC ..... E21B 21/065; E21B 21/085
See application file for complete search history.

(56) References Cited

U.S. PATENT DOCUMENTS 10,815,742 B2 * 10/2020 Holton ..... B07B 13/16
2013/0092637 A1 * 4/2013 Pomerleau ..... E21B 21/065 210/324
2015/0048037 A1 * 2/2015 Frazier ..... B07B 1/46 210/416.1
2016/0356108 A1 * 12/2016 Kutryk ..... B01D 33/03
2017/0254163 A1 * 9/2017 Ross ..... B01D 33/76

FOREIGN PATENT DOCUMENTS

CN 113101740 A * 7/2021

* cited by examiner

*Primary Examiner* — D. Andrews
(74) *Attorney, Agent, or Firm* — Bayramoglu Law Offices LLC

(57) ABSTRACT

Disclosed is an underbalanced drilling vibrating screen integrated with automatic drainage and vacuum chucks, and belongs to the technical field of solid-phase control of petroleum drilling. The underbalanced drilling vibrating screen comprises a base, a screening device and a negative pressure generating device, wherein the screening device and the negative pressure generating device are arranged on the base; the screening device comprises a shell, an exciting motor arranged on the shell, a plurality of screens arranged in the shell, and at least one drainage component; and the drainage component communicates with at least one screen through the vacuum chuck, the negative pressure generating device communicates with the vacuum chuck, and the drainage component is integrally formed with the vacuum chuck.

19 Claims, 4 Drawing Sheets

UNDERBALANCED DRILLING VIBRATING SCREEN INTEGRATED WITH AUTOMATIC DRAINAGE AND VACUUM CHUCKS

CROSS-REFERENCE TO RELATED APPLICATION

This patent application claims the benefit and priority of Chinese Patent Application No. 202210720366.0, filed with the China National Intellectual Property Administration on Jun. 23, 2022, the disclosure of which is incorporated by reference herein in its entirety as part of the present application.

TECHNICAL FIELD

The present disclosure relates to the field of solid control technology for petroleum drilling, and specifically relates to an underbalanced drilling vibrating screen integrated with automatic drainage and vacuum chucks.

BACKGROUND

The description of the background art of the present disclosure belongs to the related technology related to the present disclosure and is only intended to illustrate and facilitate the understanding of the content of the present disclosure. It should not be understood that the applicant explicitly thinks or infers that it is the prior art of the present disclosure on the application date of the first application.

A drilling fluid in the drilling vibrating screen is separated through vibration so that the liquid content of waste drilling cuttings is reduced. Negative pressure under screens is formed in an underbalanced drilling vibrating screen, and the drilling fluid is separated from the drilling cuttings under the combined action of vibration and negative pressure so that the liquid content of waste drilling cuttings is greatly reduced, the recovery rate of the drilling fluid is high, the environmental protection treatment capacity of waste drilling cuttings is low, and the economic and social benefits are remarkable.

The drainage device of the existing underbalanced drilling vibrating screen is generally installed on the base as an independent device and is connected with a drainage port of a negative pressure cavity under the screens through a drainage hose so that the drainage hose is inconvenient to install and replace. In the independent automatic drainage device, the height of the base is much higher than that of the conventional vibrating screen, so a drilling fluid inlet distribution device needs a larger height. Therefore, the application of the drilling vibrating screen in small and medium-sized drilling machines with smaller base heights is limited. When negative pressure is formed under all screens of the vibrating screen, an independent drainage device is adopted. In order to discharge the drilling fluid in time, multiple drainage hoses are needed, so that the system is more complex and the installation of the drainage hoses is more difficult.

SUMMARY

The present disclosure aims to provide an underbalanced drilling vibrating screen integrated with automatic drainage and vacuum chucks, so as to solve the problem that the structure and system of the whole negative pressure vibrating screen are complex caused by the fact that an existing negative pressure vibrating screen drainage device is complex.

The technical scheme for solving the technical problems is as follows.

An underbalanced drilling vibrating screen integrated with automatic drainage and vacuum chucks comprises a base, a screening device and a negative pressure generating device, wherein the screening device and the negative pressure generating device are arranged on the base; the screening device comprises a shell, an exciting motor arranged on the shell, a plurality of screens arranged in the shell, and at least one drainage component; and the drainage component communicates with at least one screen through the vacuum chuck, the negative pressure generating device communicates with the vacuum chuck, and the drainage component is integrally formed with the vacuum chuck.

The drainage component is integrally formed with the vacuum chuck, that is, the drainage component is an extension of the vacuum chuck. After a drilling fluid is sucked into the vacuum chuck, the drilling fluid can directly enter the drainage component and then is drained to the outside, so that the structure of the underbalanced drilling vibrating screen is simplified. A drainage hose does not need to be installed between the vacuum chuck and the drainage component so that the structure and system of the whole negative pressure vibrating screen are simplified, the installation of the screening device is the same as that of a common vibrating screen, and the screening device is simple, convenient and quick.

Further, the interior of the drainage component is provided with a U-shaped drainage channel, an inflow port is formed in one end of the drainage channel and communicates with the corresponding vacuum chuck, an overflow port is formed in the other end of the drainage channel, and flow holes are formed in the U-shaped bottom of the drainage channel.

a drilling fluid flows in from the inflow port, most of the drilling fluid overflows from the overflow port, and a small amount of the drilling fluid flows out from the flow holes, so that the automatic discharge of the drilling fluid is realized.

The drainage component is adapted to discharge the drilling fluid in the waste drilling cuttings, and the drilling fluid enters the drainage channel of the drainage component from the screens. Most of the drilling fluid is discharged to the outside in an overflowing way, and a small amount of the drilling fluid is discharged to the outside through the flow holes. After the machine is stopped, no residual drilling fluid exists in the drainage component, so the disassembly of the drainage component is avoided. The drainage component is directly connected with the screens, so that the structure and system of the whole vibrating screen are simplified, and the drainage operation is simpler.

Further, the bottom of the drainage channel is inclined downward from the inflow port to the overflow port, and the flow holes are formed in the lowest area of the drainage channel.

The flow holes are formed in the lowest area of the drainage channel so that the discharge of the residual drilling fluid in the drainage component is facilitated when the machine is stopped.

Further, the drainage component comprises a front side plate, a rear side plate, a left side plate, a right side plate, an intercepting plate and an inclined bottom plate.

Two sides of the intercepting plate are respectively connected with the front side plate and the rear side plate, and a gap is formed between the intercepting plate and the bottom plate so that a U-shaped drainage channel is formed inside the drainage component. The front side plate, the rear side plate, the left side plate and the intercepting plate form the inflow port, and the front side plate, the rear side plate, the left side plate and the intercepting plate are integrally formed with the vacuum chuck. The front side plate, the rear side plate, the right side plate and the intercepting plate form the overflow port.

Further, the flow holes are formed in the position where the bottom plate and the right side plate are connected, and the number of the flow holes is multiple.

Further, the side wall of the shell is provided with ventilation units, and the number and position of the ventilation units respectively correspond to those of the vacuum chucks; and the ventilation unit comprises a vertical channel, a transverse channel and an air suction joint, the bottom of the vertical channel communicates with the corresponding vacuum chuck, two ends of the transverse channel respectively communicate with the top of the vertical channel, and the air suction joint, and the air suction joint is located on the top of the shell and communicates with the negative pressure generating device through a vacuum tube.

The vertical channel and the transverse channel are formed in the side wall of the shell. The air suction joint is located on the top of the shell. The vacuum tube communicates with the air suction structure from the top of the shell so that the width of the underbalanced drilling vibrating screen is reduced, the total width is the same as that of the common drilling vibrating screen with the same specifications, and the occupied area is reduced.

Further, the outer side wall of the shell is vertically welded with the first U-shaped steel to form the vertical channel, the inner side wall of the shell is transversely welded with the second U-shaped steel to form the transverse channel, two ends of the first U-shaped steel and two ends of the second U-shaped steel are blocked, and the vertical channel respectively communicates with the vacuum chuck and the transverse channel through holes formed in the shell.

Further, the negative pressure generating device comprises a support and exhaust fans arranged on the support; the top cross beam of the support is hollow, and the exhaust fan and the vacuum tube respectively communicate with the top cross beam.

A three-way pipeline in the negative pressure generating device is integrated with the support so that the device is compact in structure and convenient to install.

The present disclosure has the following beneficial effects.

Firstly, the drainage component is directly connected to the screen, the use of the drainage hose is avoided, and the structure and system of the whole negative pressure vibrating screen are simplified so that the drainage operation is simpler.

Secondly, the drainage component can realize self-drainage. When the machine is stopped, the residual drilling fluid in the drainage component and other positions can be automatically discharged through the flow holes.

Thirdly, compared with the common vibrating screen, the height and width of the underbalanced drilling vibrating screen do not need to be increased. The base which is the same as the common vibrating screen can be adopted to improve the application on small and medium-sized drilling machines with lower base heights.

Fourthly, the three-way pipeline in the negative pressure generating device is integrated with the support, so that the device is compact in structure and convenient to install.

Reference signs: 10, base; 20, screening device; 21, shell; 22, exciting motor; 23, screen; 24, drainage component; 25, drainage channel; 26, vacuum chuck; 30, negative pressure generating device; 31, vacuum tube; 32, support; 33, exhaust fan; 34, top cross beam; 211, vertical channel; 212, transverse channel; 213, air suction joint; 214, first U-shaped steel; 215, second U-shaped steel; 216, hole; 241, front side plate; 242, rear side plate; 243, left side plate; 244, right side plate; 245, intercepting plate; 246, bottom plate; 247, gap; 251, inflow port; 252, overflow port; and 253, flow hole.

DETAILED DESCRIPTION OF THE EMBODIMENTS

The principles and features of the present disclosure are introduced in detail in combination with the following attached figures, the examples are only intended to describe the present disclosure, but not intended to limit the scope of the present disclosure.

The embodiment provides an underbalanced drilling vibrating screen integrated with automatic drainage and vacuum chucks. The negative pressure generating device 30 generates negative pressure on the vacuum chucks 26, and negative pressure absorbs a drilling fluid on screens 23. The drilling fluid flows from the vacuum chucks 26 into a drainage component 24 and is finally discharged to the outside.

Figure 1:
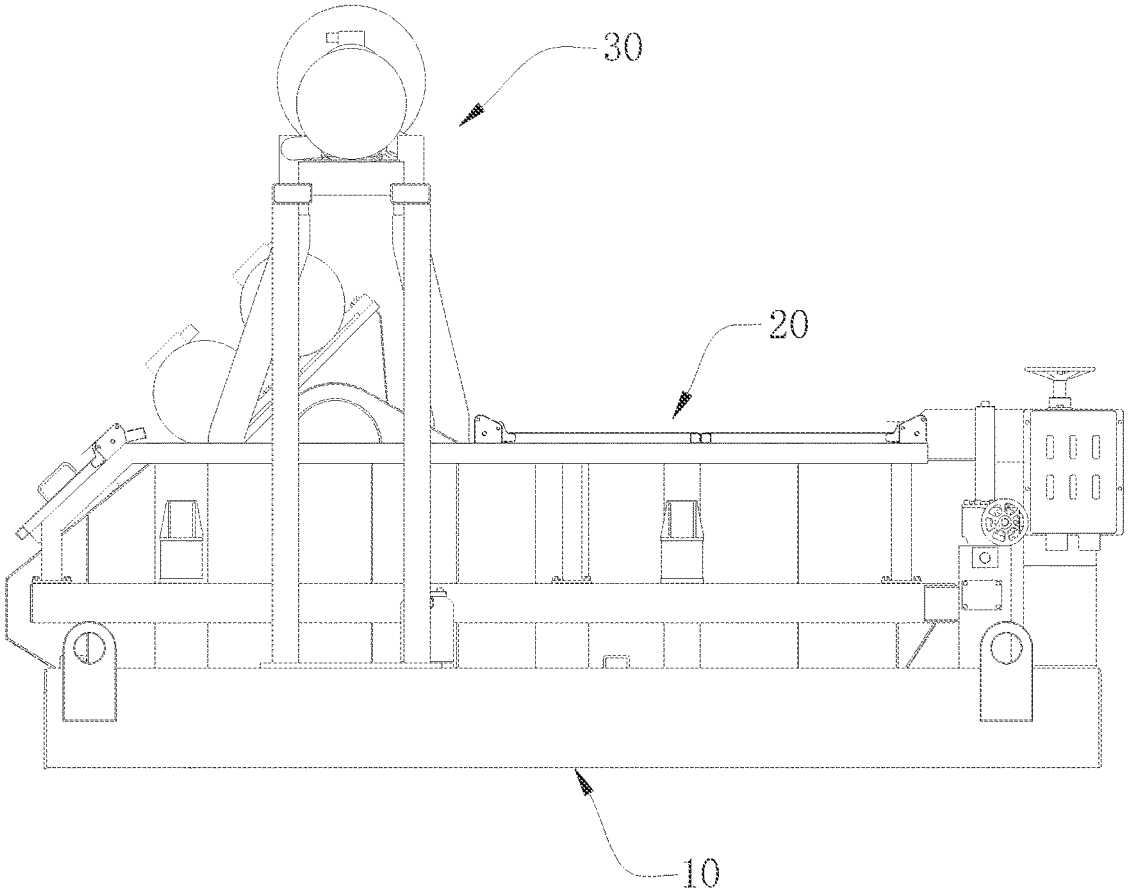
FIG. 1 is a structural schematic diagram of an underbalanced drilling vibrating screen integrated with automatic drainage and vacuum chucks in the present disclosure.
Figure 2:
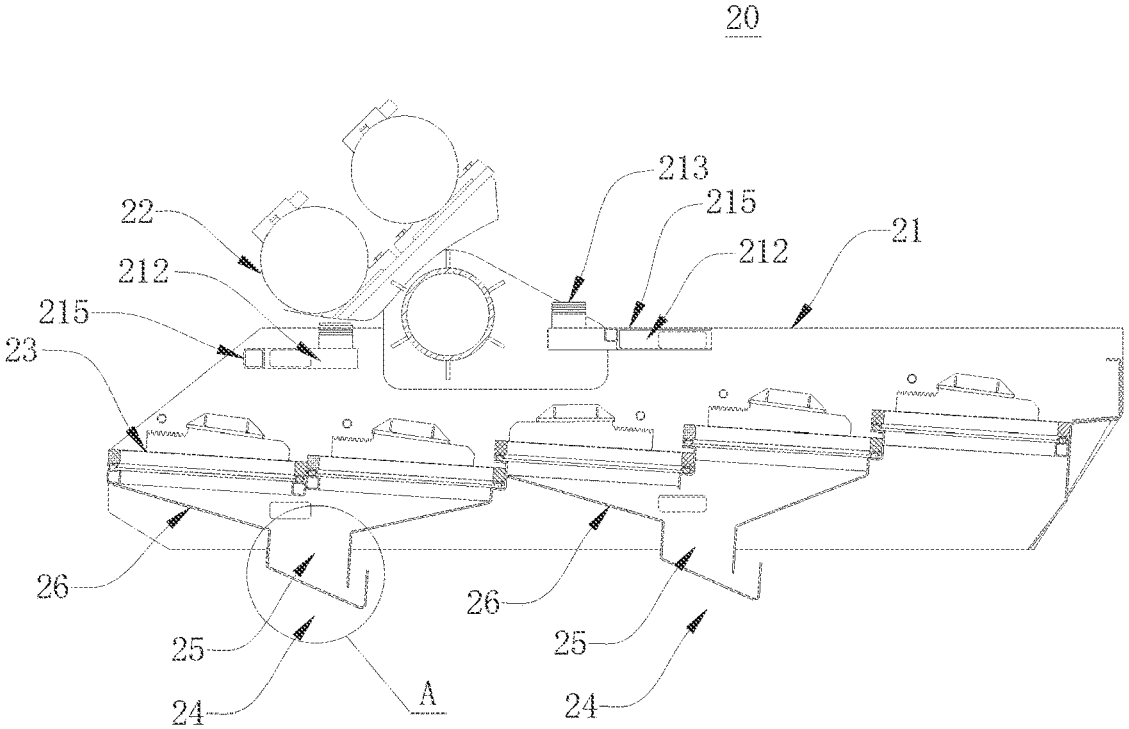
FIG. 2 is an internal structural schematic diagram of a screening device in the present disclosure.

Referring to FIG. 1, an underbalanced drilling vibrating screen integrated with automatic drainage and vacuum chucks comprises a base 10, a screening device 20 and a negative pressure generating device 30. The screening device 20 is connected with the base 10 through an inclination adjusting mechanism 6. The screening device 20 and the inclination adjusting mechanism 6 are connected through a spring. Due to the existence of the spring, the screening device 20 can shake in a large arc when vibrating so that the drilling fluid and waste drilling cuttings are convenient to separate. The specific mechanism of the inclination adjusting mechanism and the specific connection structure between the inclination adjusting mechanism, the base 10 and the screening device 20 belong to the prior art, and are not repeated here. The negative pressure generating device 30 is installed on the base 10, and absorbs the drilling fluid in the waste drilling cuttings by generating negative pressure.

Referring to FIG. 2 to FIG. 5, the screening device 20 comprises a shell 21. An exciting motor 22 for generating vibration is installed on the shell 21 through a motor base. The interior of the shell 21 is provided with a plurality of the screens 23 arranged in sequence. The number of the screens 23 is set according to the recovery degree of the drilling fluid, the amount of the waste drilling cuttings and the like. In the embodiment, the number of the screens 23 is five, and the screens are respectively a first screen, a second screen, a third screen, a fourth screen and a fifth screen in sequence. Each screen is provided with a screen tensioning mechanism. Various protective covers on the shell 21, the exciting motor 22 and the screen tensioning mechanism belong to the prior art, and are not repeated here. In other embodiments of the present disclosure, the number of the screens further can be one, two, three, four and the like.

The bottoms of the first screen and the second screen are provided with vacuum chucks. The bottoms of the second screen and the third screen are also provided with vacuum chucks 26. The bottom of each vacuum chuck 26 is respectively connected with a drainage component 24. In other embodiments of the present disclosure, one, three, four or five screens may correspond to one vacuum chuck 26, and the number of the vacuum chucks 26 may be one, three, four, five and the like.

The interior of the drainage component 24 is provided with a U-shaped drainage channel 25. Two ports of the drainage channel 25 are respectively an inflow port 251 and an overflow port 252. The inflow port 251 communicates with the vacuum chuck 26. The height of the overflow port 252 is lower than that of the inflow port 251. After the drilling fluid enters the drainage channel 25, the drilling fluid flows out from the overflow port 252. At this time, the drilling fluid can block the drainage channel 25 to avoid the circulation of gas. During negative pressure adsorption, no air can enter the vacuum chuck 26 from the drainage channel 25. A row of flow holes 253 are formed in the bottom of the drainage channel 25. When the machine is stopped, the drilling fluid remaining in the drainage channel 25 and the vacuum chuck 26 flows out from the flow holes 253, so that the automatic discharge of the drilling fluid is realized.

Figure 3:
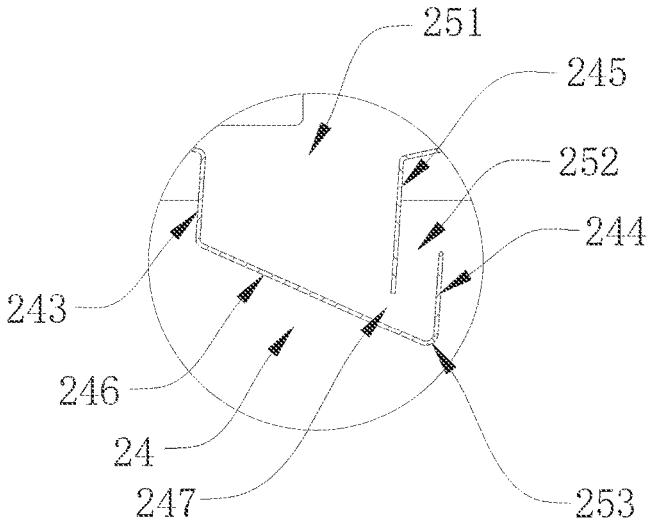
FIG. 3 is an enlarged drawing at the position of A in FIG. 2.
Figure 4:
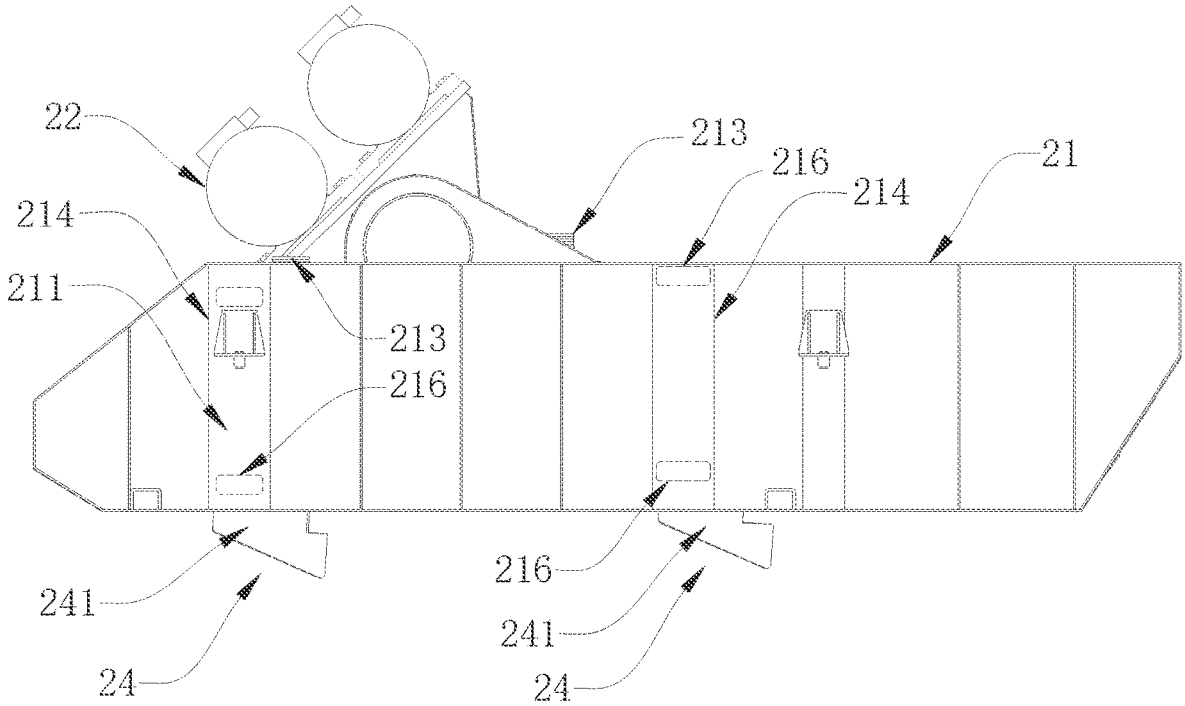
FIG. 4 is an external structural schematic diagram of a screening device in the present disclosure.
Figure 5:
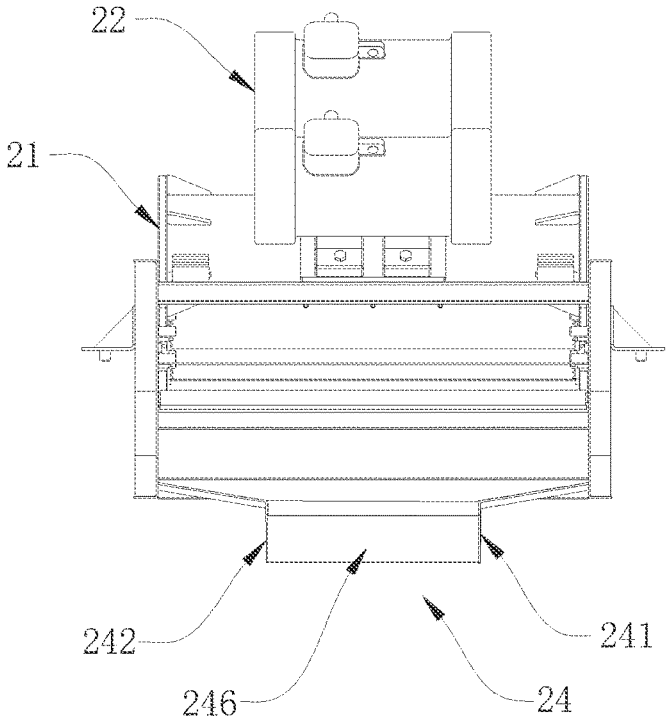
FIG. 5 is a side-looking structural schematic diagram of a screening device in the present disclosure.

Referring to FIG. 3, in the embodiment, the drainage component 24 comprises a front side plate 241, a rear side plate 242, a left side plate 243, a right side plate 244, an intercepting plate 245 and a bottom plate 246. The front side plate 241 and the rear side plate 242 are opposite to each other. The left side plate 243 and the right side plate 244 are opposite to each other. The front side plate 241, the rear side plate 242, the left side plate 243 and the right side plate 244 are surrounded together and connected to form a drainage cavity. The bottom plate 246 is respectively connected with the front side plate 241, the rear side plate 242, the left side plate 243 and the right side plate 244 to form the bottom wall of the drainage cavity. The intercepting plate 245 is located between the front side plate 241 and the rear side plate 242 and respectively connected with the front side plate 241 and the rear side plate 242. At the same time, a gap 247 is formed between the bottom of the intercepting plate 245 and the bottom plate 246, so that the drainage cavity is U-shaped, that is, a U-shaped drainage channel 25 is formed. At this time, the inflow port 251 is formed among the front side plate 241, the rear side plate 242, the left side plate 243 and the intercepting plate 245. The overflow port 252 is formed among the front side plate 241, the rear side plate 242, the right side plate 244 and the intercepting plate 245. Since the U-shaped drainage channel 25 is formed, the height of the gap 247 is lower than that of the overflow port 252.

In the embodiment, the bottom plate 246 is arranged obliquely, specifically inclining downward in the direction from the inflow port 251 to the overflow port 252, that is, the position where the bottom plate 246 is connected with the right side plate 244 is in the lowest area. The flow holes 253 are formed in the position where the bottom plate 246 is connected with the right side plate 244. At the same time, a plurality of flow holes 253 are sequentially formed in the position where the bottom plate 246 is connected with the right side plate 244. In other embodiments of the present disclosure, the bottom plate 246 can also be inclined in any other direction, even bent, as long as the flow hole 253 is formed in the lowest area.

Preferably, the vacuum chuck 26 is integrally formed with the drainage component 24, that is, the drainage component is an extension of the vacuum chuck. After the drilling fluid is sucked into the vacuum chuck, the drilling fluid can directly enter the drainage component and then is drained to the outside, so that the structure of the underbalanced drilling vibrating screen is simplified. A drainage hose does not need to be installed between the vacuum chuck 26 and the drainage component 24, and the installation of the screening device is the same as that of a common vibrating screen and is simple, convenient and quick. Specifically, the front side plate 241, the rear side plate 242, the left side plate 243 and the intercepting plate 245 are respectively connected with the vacuum chuck 26 in a sealed and fixed manner.

Figure 6:
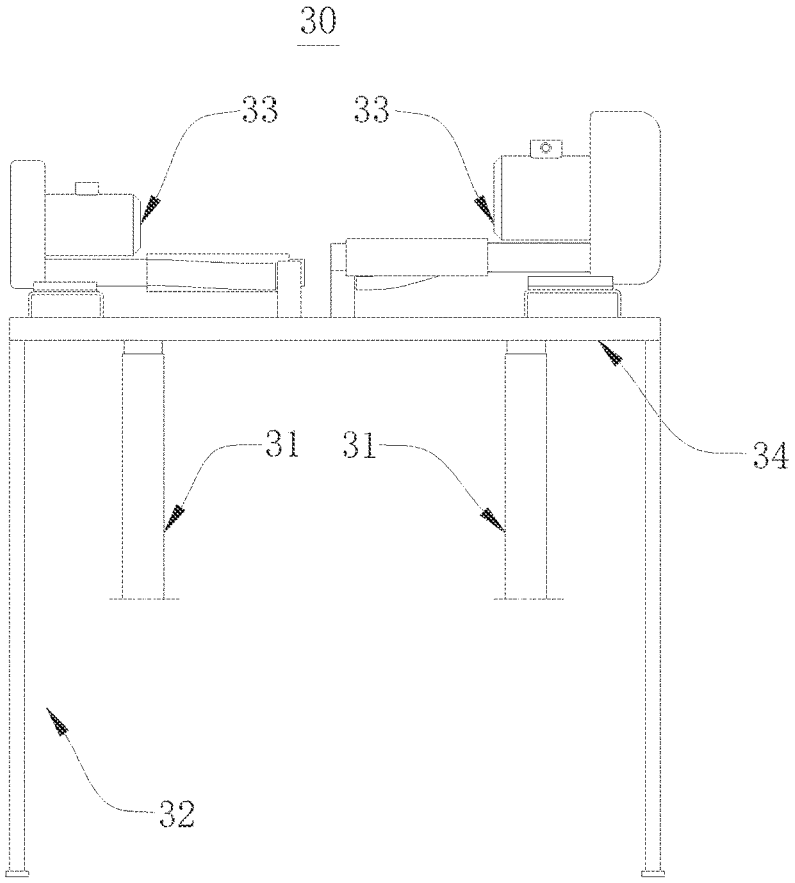
FIG. 6 is a structural schematic diagram of a negative pressure generating device in the present disclosure.
Figure 7:
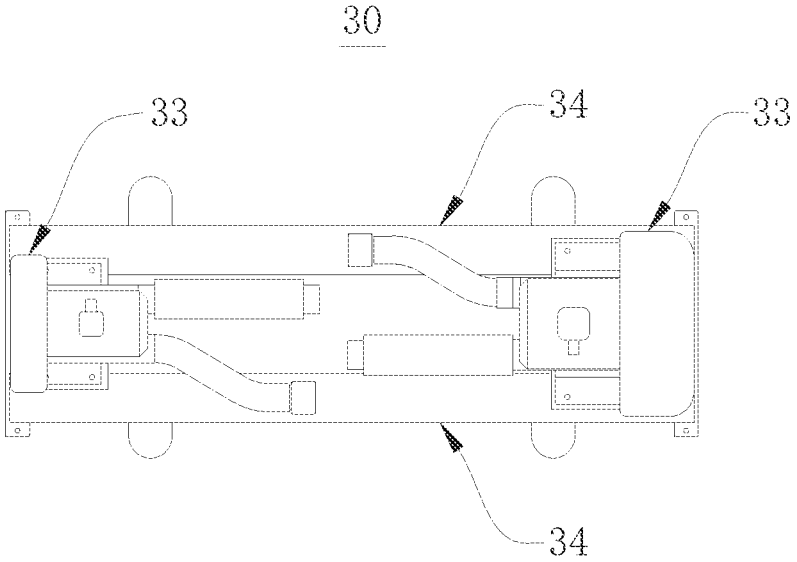
FIG. 7 is a top structural schematic diagram of a negative pressure generating device in the present disclosure.

Referring to FIG. 6 and FIG. 7, the negative pressure generating device 30 comprises a support 32 and exhaust fans 33. The support 32 is fixedly arranged on the base 10, and the exhaust fans 33 are fixedly arranged on the support 32. The number of the exhaust fans 33 can be in one-to-one correspondence with the vacuum chucks 26, or all the vacuum chucks 26 can correspond to one same exhaust fan 33. In the embodiment, two exhaust fans 33 are provided, and each suction fan 33 corresponds to one vacuum chuck 26. The embodiment only describes the communication between one suction fan 33 and the corresponding vacuum chuck 26.

The support 32 comprises a plurality of vertical rods and top cross beams 34 arranged on the tops of the vertical rods. The top cross beam 34 is hollow, and the exhaust fan 33 is installed on the top cross beam 34 and communicates with the interior of the top cross beam 34. In the embodiment, since the number of the exhaust fans 33 is two, the number of top cross beams 34 is also two, and the top cross beams 34 are in one-to-one correspondence with the exhaust fans 33. Obviously, in other embodiments of the present disclosure, two cavities are formed in the top cross beam 34, and the cavities are in one-to-one correspondence with the exhaust fan 33.

The top cross beam 34 is connected with a vacuum tube 31, and a three-way pipeline in the negative pressure generating device 30 is integrated with the support so that the device is compact in structure and convenient to install. The vacuum tube 31 communicates with the corresponding vacuum chuck 26 through a ventilation unit. The ventilation unit comprises a vertical channel 211 and a transverse channel 212 which are located on the shell 21.

Referring to FIG. 1 to FIG. 7, the outer side wall of the shell 21 is vertically welded with first U-shaped steel 214. Two ends of the first U-shaped steel 214 are closed. The vertical channel 211 is formed between the first U-shaped steel 214 and the outer side wall of the shell 21. The shell 211 is provided with holes 216 near the two ends of the first U-shaped steel 214. The vertical channel 211 communicates with the corresponding vacuum chuck 26 through the hole 216 (specifically, the vertical channel 211 and the corresponding vacuum chuck 26 can be connected by pipes.). The inner side wall of the shell 21 is provided with second U-shaped steel 215. The transverse channel 212 is formed between the second U-shaped steel 215 and the inner side wall of the shell 21. The second U-shaped steel 215 is provided with an air suction joint 213. One end of the transverse channel 212 communicates with the vertical channel 211 through the hole 216, and the other end of the transverse channel 212 communicates with the air suction joint 213. The air suction joint 213 communicates with the corresponding vacuum tube 31. Through the arrangement of the vertical channel 211 and the transverse channel 212, the vacuum tube 31 and the vacuum chuck 26 are connected, and the overall width of the underbalanced drilling vibrating screen is the same as that of a common drilling vibrating screen so that the occupied area is reduced.

The foregoing descriptions are merely exemplary embodiments of the present disclosure, but are not intended to limit the present disclosure. Any modification, equivalent replacement, or improvement made within the spirit and principle of the present disclosure shall fall within the protection scope of the present disclosure.

What is claimed is:

1. An underbalanced drilling vibrating screen integrated with automatic drainage and vacuum chucks, comprising a base, a screening device and a negative pressure generating device, wherein the screening device and the negative pressure generating device are arranged on the base; the screening device comprises a shell, an exciting motor arranged on the shell, a plurality of screens arranged in the shell, and at least one drainage component; and each of the at least one drainage component communicates with at least one of the plurality of screens through a corresponding vacuum chuck of the vacuum chucks, the negative pressure generating device communicates with the vacuum chucks, and the at least one drainage component is integrally formed with the vacuum chucks;

wherein the interior of the drainage component is provided with a U-shaped drainage channel, an inflow port is formed in one end of the drainage channel and communicates with the corresponding vacuum chuck, an overflow port is formed in the other end of the drainage channel, and flow holes are formed in the U-shaped bottom of the drainage channel; and a drilling fluid flows in from the inflow port, a first amount of the drilling fluid overflows from the overflow port, a second amount of the drilling fluid flows out from the flow holes, and the first amount is greater than the second amount, so that an automatic discharge of the drilling fluid is realized.

2. The underbalanced drilling vibrating screen integrated with automatic drainage and vacuum chucks according to claim 1, wherein the bottom of the drainage channel is inclined downward from the inflow port to the overflow port, and the flow holes are formed in the lowest area of the drainage channel.

3. The underbalanced drilling vibrating screen integrated with automatic drainage and vacuum chucks according to claim 2, wherein the drainage component comprises a front side plate, a rear side plate, a left side plate, a right side plate, an intercepting plate and an inclined bottom plate; and two sides of the intercepting plate are respectively connected with the front side plate and the rear side plate, and a gap is formed between the intercepting plate and the bottom plate, so that the U-shaped drainage channel is formed in the interior of the drainage component, the front side plate, the rear side plate, the left side plate and the intercepting plate form the inflow port, the front side plate, the rear side plate, the left side plate and the intercepting plate are integrally formed with the vacuum chucks, and the front side plate, the rear side plate, the right side plate and the intercepting plate form the overflow port.

4. The underbalanced drilling vibrating screen integrated with automatic drainage and vacuum chucks according to claim 3, wherein the flow holes are located at the position where the bottom plate and the right side plate are connected, and the number of the flow holes is multiple.

5. The underbalanced drilling vibrating screen integrated with automatic drainage and vacuum chucks according to claim 4, wherein the side wall of the shell is provided with ventilation units, and the number and position of the ventilation units respectively correspond to the number and position of the vacuum chucks; and the ventilation unit comprises a vertical channel, a transverse channel and an air suction joint, the bottom of the vertical channel communicates with a corresponding vacuum chuck of the vacuum chucks, two ends of the transverse channel respectively communicate with the top of the vertical channel and the air suction joint, and the air suction joint is located on the top of the shell and communicates with the negative pressure generating device through a vacuum tube.

6. The underbalanced drilling vibrating screen integrated with automatic drainage and vacuum chucks according to claim 5, wherein the outer side wall of the shell is vertically welded with first U-shaped steel to form the vertical channel, the inner side wall of the shell is transversely welded with second U-shaped steel to form the transverse channel, two ends of the first U-shaped steel and two ends of the second U-shaped steel are blocked, and the vertical channel respectively communicates with the vacuum chucks and the transverse channel through holes formed in the shell.

7. The underbalanced drilling vibrating screen integrated with automatic drainage and vacuum chucks according to claim 6, wherein the negative pressure generating device comprises a support and exhaust fans arranged on the support; and a top cross beam of the support is hollow, and the exhaust fan and the vacuum tube-respectively communicate with the top cross beam.

8. The underbalanced drilling vibrating screen integrated with automatic drainage and vacuum chucks according to claim 4, wherein the side wall of the shell is provided with ventilation units, and the number and position of the ventilation units respectively correspond to the number and position of the vacuum chucks; and the ventilation unit comprises a vertical channel, a transverse channel and an air suction joint, the bottom of the vertical channel communicates with a corresponding vacuum chuck of the vacuum chucks, two ends of the transverse channel respectively communicate with the top of the vertical channel and the air suction joint, and the air suction joint is located on the top of the shell and communicates with the negative pressure generating device through a vacuum tube.

9. The underbalanced drilling vibrating screen integrated with automatic drainage and vacuum chucks according to claim 8, wherein the outer side wall of the shell is vertically welded with first U-shaped steel to form the vertical channel, the inner side wall of the shell is transversely welded with second U-shaped steel to form the transverse channel, two ends of the first U-shaped steel and two ends of the second U-shaped steel are blocked, and the vertical channel respectively communicates with the vacuum chucks and the transverse channel through holes formed in the shell.

10. The underbalanced drilling vibrating screen integrated with automatic drainage and vacuum chucks according to claim 9, wherein the negative pressure generating device comprises a support and exhaust fans arranged on the support; and a top cross beam of the support is hollow, and the exhaust fan and the vacuum tube-respectively communicate with the top cross beam.

11. The underbalanced drilling vibrating screen integrated with automatic drainage and vacuum chucks according to claim 3, wherein the side wall of the shell is provided with ventilation units, and the number and position of the ventilation units respectively correspond to the number and position of the vacuum chucks; and the ventilation unit comprises a vertical channel, a transverse channel and an air suction joint, the bottom of the vertical channel communicates with a corresponding vacuum chuck of the vacuum chucks, two ends of the transverse channel respectively communicate with the top of the vertical channel and the air suction joint, and the air suction joint is located on the top of the shell and communicates with the negative pressure generating device through a vacuum tube.

12. The underbalanced drilling vibrating screen integrated with automatic drainage and vacuum chucks according to claim 8, wherein the outer side wall of the shell is vertically welded with first U-shaped steel to form the vertical channel, the inner side wall of the shell is transversely welded with second U-shaped steel to form the transverse channel, two ends of the first U-shaped steel and two ends of the second U-shaped steel are blocked, and the vertical channel respectively communicates with the vacuum chucks and the transverse channel through holes formed in the shell.

13. The underbalanced drilling vibrating screen integrated with automatic drainage and vacuum chucks according to claim 12, wherein the negative pressure generating device comprises a support and exhaust fans arranged on the support; and a top cross beam of the support is hollow, and the exhaust fan and the vacuum tube-respectively communicate with the top cross beam.

14. The underbalanced drilling vibrating screen integrated with automatic drainage and vacuum chucks according to claim 1, wherein the side wall of the shell is provided with ventilation units, and the number and position of the ventilation units respectively correspond to the number and position of the vacuum chucks; and the ventilation unit comprises a vertical channel, a transverse channel and an air suction joint, the bottom of the vertical channel communicates with a corresponding vacuum chuck of the vacuum chucks, two ends of the transverse channel respectively communicate with the top of the vertical channel and the air suction joint, and the air suction joint is located on the top of the shell and communicates with the negative pressure generating device through a vacuum tube.

15. The underbalanced drilling vibrating screen integrated with automatic drainage and vacuum chucks according to claim 14, wherein the outer side wall of the shell is vertically welded with first U-shaped steel to form the vertical channel, the inner side wall of the shell is transversely welded with second U-shaped steel to form the transverse channel, two ends of the first U-shaped steel and two ends of the second U-shaped steel are blocked, and the vertical channel respectively communicates with the vacuum chucks and the transverse channel through holes formed in the shell.

16. The underbalanced drilling vibrating screen integrated with automatic drainage and vacuum chucks according to claim 15, wherein the negative pressure generating device comprises a support and exhaust fans arranged on the support; and a top cross beam of the support is hollow, and the exhaust fan and the vacuum tube-respectively communicate with the top cross beam.

17. An underbalanced drilling vibrating screen integrated with automatic drainage and vacuum chucks, comprising a base, a screening device and a negative pressure generating device, wherein the screening device and the negative pressure generating device are arranged on the base; the screening device comprises a shell, an exciting motor arranged on the shell, a plurality of screens arranged in the shell, and at least one drainage component; and each of the at least one drainage component communicates with at least one of the plurality of screens through a corresponding vacuum chuck of the vacuum chucks, the negative pressure generating device communicates with the vacuum chucks, and the at least one drainage component is integrally formed with the vacuum chucks;

wherein the side wall of the shell is provided with ventilation units, and number and position of the ventilation units respectively correspond to the number and position of the vacuum chucks; and the ventilation unit comprises a vertical channel, a transverse channel and an air suction joint, the bottom of the vertical channel communicates with a corresponding vacuum chuck of the vacuum chucks, two ends of the transverse channel respectively communicate with the top of the vertical channel and the air suction joint, and the air suction joint is located on the top of the shell and communicates with the negative pressure generating device through a vacuum tube.

18. The underbalanced drilling vibrating screen integrated with automatic drainage and vacuum chucks according to claim 6, wherein the outer side wall of the shell is vertically welded with first U-shaped steel to form the vertical channel, the inner side wall of the shell is transversely welded with second U-shaped steel to form the transverse channel, two ends of the first U-shaped steel and two ends of the second U-shaped steel are blocked, and the vertical channel respectively communicates with the vacuum chucks and the transverse channel through holes formed in the shell.

19. The underbalanced drilling vibrating screen integrated with automatic drainage and vacuum chucks according to claim 18, wherein the negative pressure generating device comprises a support and exhaust fans arranged on the support; and a top cross beam of the support is hollow, and the exhaust fan and the vacuum tube-respectively communicate with the top cross beam.

* * * * *